US005566950A

United States Patent [19]

Senna

[11] Patent Number: 5,566,950

[45] Date of Patent: Oct. 22, 1996

[54] URINAL ARCADE GAME

[76] Inventor: Randall Senna, 1 Rolling Knolls Dr., Middletown, N.J. 07748

[21] Appl. No.: 384,522

[22] Filed: Feb. 1, 1995

[51] Int. Cl.[6] ..... A63B 67/00

[52] U.S. Cl. ..... 463/60; 273/354; 273/349; 463/58

[58] Field of Search ..... 273/85 R, 86 R, 273/85 H, 313, 314, 315, 349, 354, 359, 369, 378, 382, 440

[56] References Cited

U.S. PATENT DOCUMENTS

| | | | |
|---|---|---|---|
| 2,759,731 | 8/1956 | Quinn | 273/349 |
| 3,336,030 | 8/1967 | Martell et al. | 273/349 |
| 3,342,492 | 9/1967 | Barrett | 273/349 |
| 3,405,941 | 10/1968 | Martell et al. | 273/349 |
| 3,572,712 | 3/1971 | Vick | 273/349 |
| 4,699,386 | 10/1987 | Carzino | 273/354 |

FOREIGN PATENT DOCUMENTS

| | | | |
|---|---|---|---|
| 17628 | 7/1909 | United Kingdom | 273/354 |

*Primary Examiner*—Vincent Millin
*Assistant Examiner*—William M. Pierce
*Attorney, Agent, or Firm*—Ira M. Adler, Esq.

[57] ABSTRACT

The invention relates to a to a arcade amusement game in which contestants compete to be the first to shoot a given amount of water from a distant water gun into an replica urinal, while a simulated man is made to move back and forth in front of the bowl. The invention contains a means of tracking the amount of water entering the urinal replica.

1 Claim, 12 Drawing Sheets

URINAL ARCADE GAME

BACKGROUND

1. Field of Invention

The invention relates to a arcade amusement game in which contestants compete to be the first to shoot a given amount of water from a distant water gun into a replica urinal, while a simulated man is made to move back and forth in front of the bowl. The invention contains a means of tracking the amount of water entering the urinal replica.

2. Description of Prior Art

While prior art, such as Burnett, U.S. Pat. No. 3,342,492, F. Martell et, U.S. Pat. No. 3,336,030, Vick, U.S. Pat. No. 3,572,712 and Miller, U.S. Pat. No. 3,362,713 each describe a water gun based amusement arcade game, no prior art discloses water gun based games having a simulated urinal targets with a human figure as a blocking means. While Burnett teaches a float ball display mechanism the rising ball doesn't initiate a "win" display of lights and sound as in the present invention.

OBJECT & ADVANTAGES

The object of the invention is a water gun based amusement arcade game simulative of a male urinal which permits contestants to compete as to their ability to fire a water gun into a replica of a urinal, in the face of a blocking mechanism.

DRAWING FIGURES

SPECIFICATION

Figure 1:
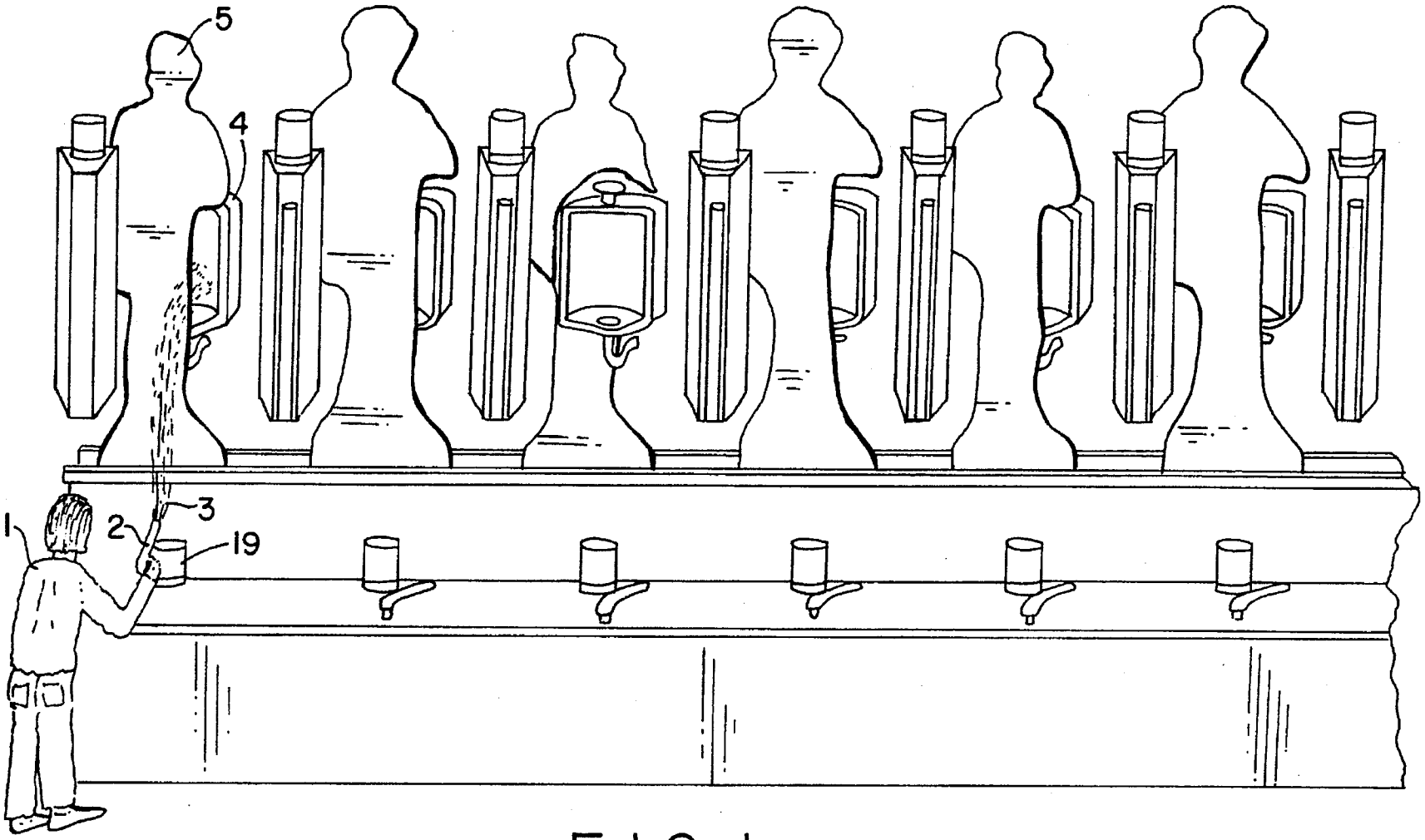
FIG. 1 is a frontal view of the invention showing a multiplicity of game stations.

Typically in the use of the invention, as shown in FIG. 1, each of several contestants or participants, 1, as shown in FIG. 1, stands in front of a station. Each is presented with a water gun, 2, the water output, 3, of which is aimed at a urinal replica, 4, which is located several feet away, and in front of the contestant. A simulated figure of a male, 5, is placed immediately in front of each urinal replica.

Figure 2:
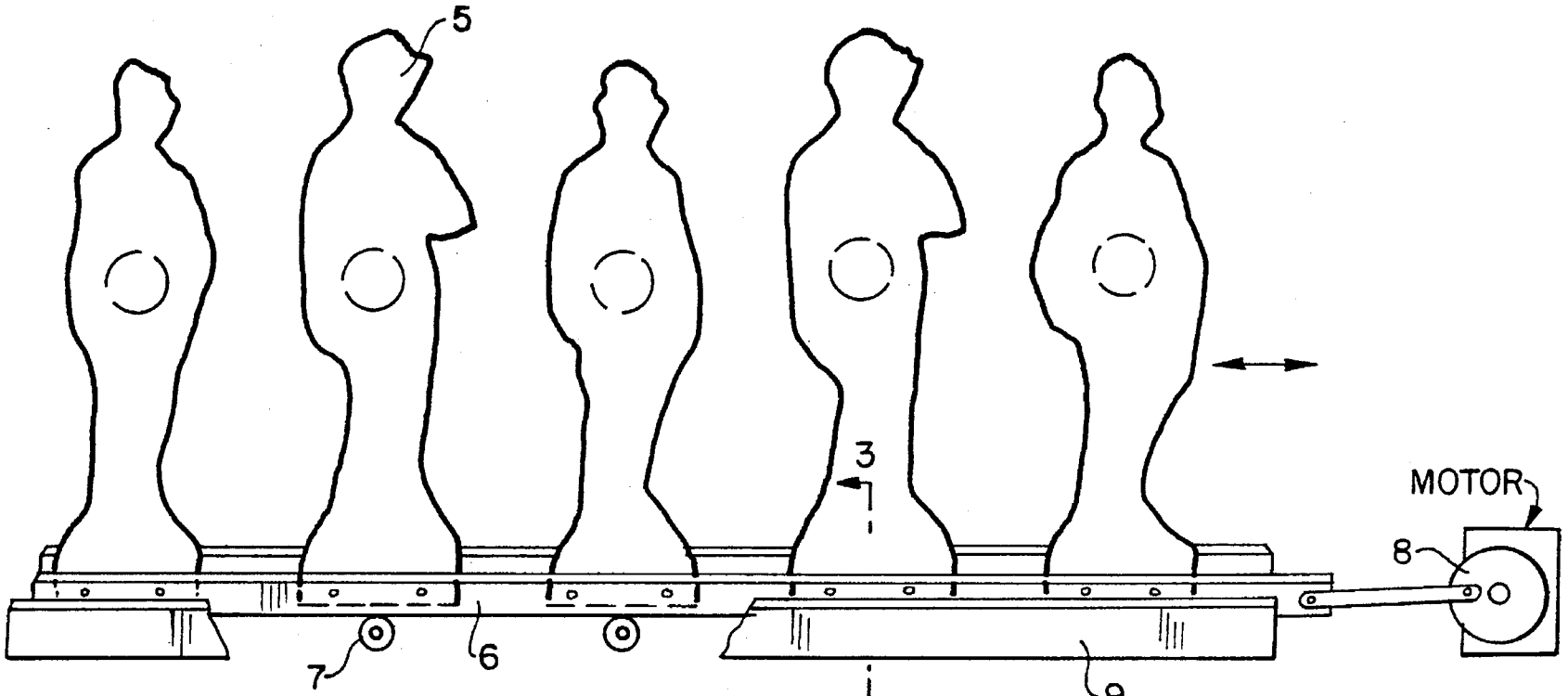
FIG. 2 is a detail of the blocking mechanism.
Figure 3:
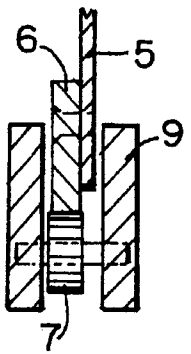
FIG. 3 is a partial side section of one of the blocking stations.

The figures, 5, are connected to each other, as seen in FIG. 2, by a bar, 6, and made to slide horizontally back and forth over a set of wheels, 7, under control of a motorized cam mechanism, 8, alternatively blocking and exposing the replica of the urinal. FIG. 3 shows a partial section of the blocking mechanism. A rail, 9, encloses the wheel mechanism. The contestant attempts to aim the water from the water gun into the urinal replica when the opening in front of the urinal is exposed.

Figure 4:
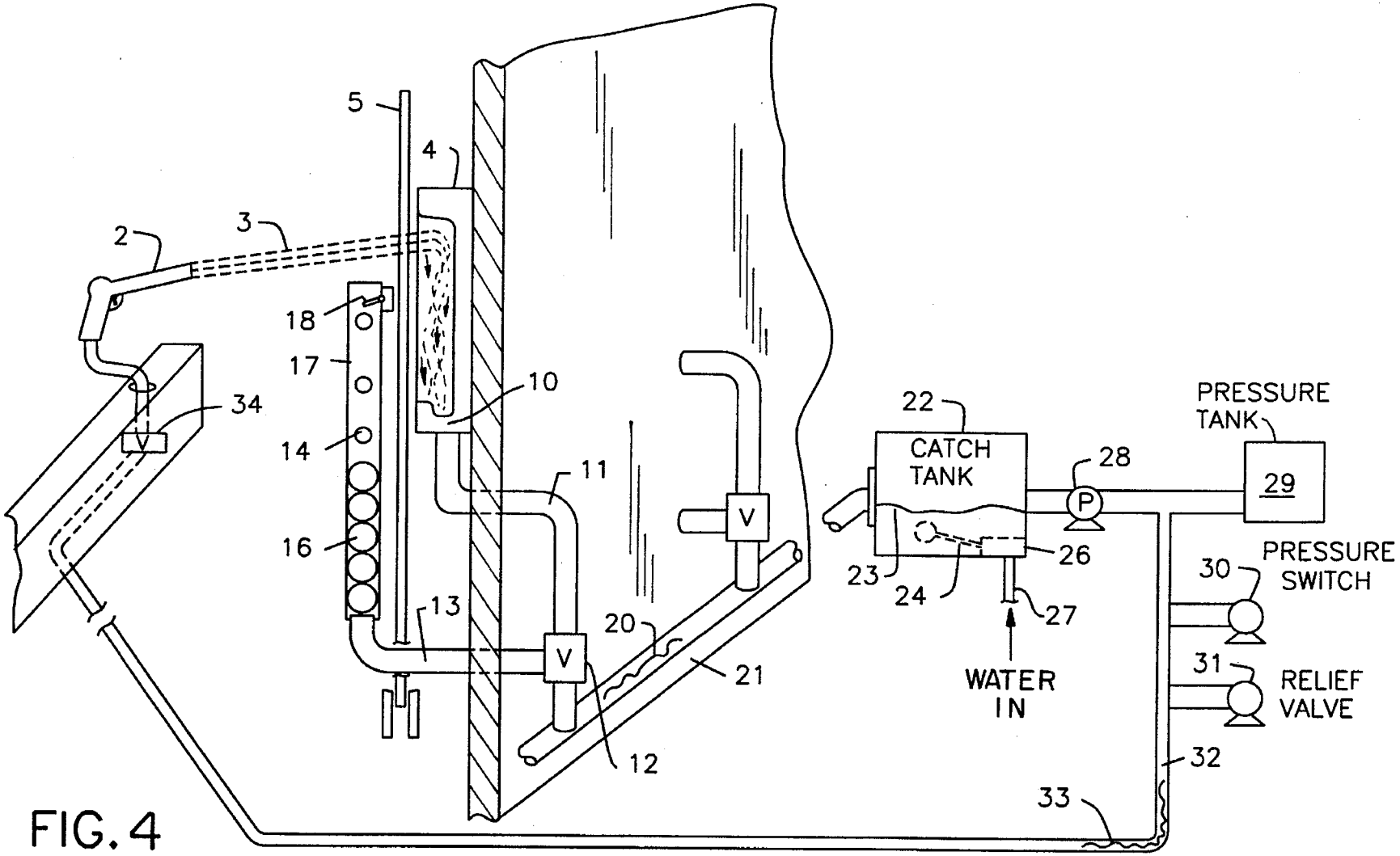
FIG. 4 is perspective view of one station.

As in FIG. 4, the water stream, 3, from the water gun, 2, entering the urinal replica, flows down to the bottom, 10, of the urinal replica, 4, and out through a drain, 11. The water flows to valve "B", 12, in its closed position, directs the water through a pipe, 13, to a sight tube, 14. The water then rises up the sight tube, 14, which contains a multiple of floating balls, 16. As the water accumulates, 17, in the sight tube, the balls rise. The length of the balls is the same as the distance from the bottom of the urinal replica to a microswitch, 18. In the tube of the winning contestant, the balls come into contact with the microswitch at the top of the tube. This causes a light to signal that a contestant has won the game. The signal, 19, is shown in FIG. 1.

At the end of the game, valve "B", 12, is opened, on a signal from the game end circuit, causing the water in the sight tube to return, 20, via a pipe, 21, to a catch tank, 22. The level, 23, in the catch tank, 22, is controlled by means of a float mechanism, 24. When the float falls to a set point, a valve "C", 26, opens, allowing water, 27, from outside the system enters the catch tank.

A pump, 28, regulates the water pressure together with the pressure tank, 29, for flow to the water guns, 2. The pump, 28, runs when the pressure in the pressure tank, 29, falls, causing the pressure switch, 30, to activate the pump, 28. The pressure is maintained, whether or not the game is in play. The guns are solenoid controlled, such that when the trigger is activated, water, 3, under pressure is released, but only if a player has had a stationed activated. Relief valve, 31, releases pressure in the water line, 32, if pressure exceeds safety limits. Water, 33, in the water line, 32, flows to the guns, 2, through valve "A", 34 if a particular station has been activated for participation.

Figure 5:
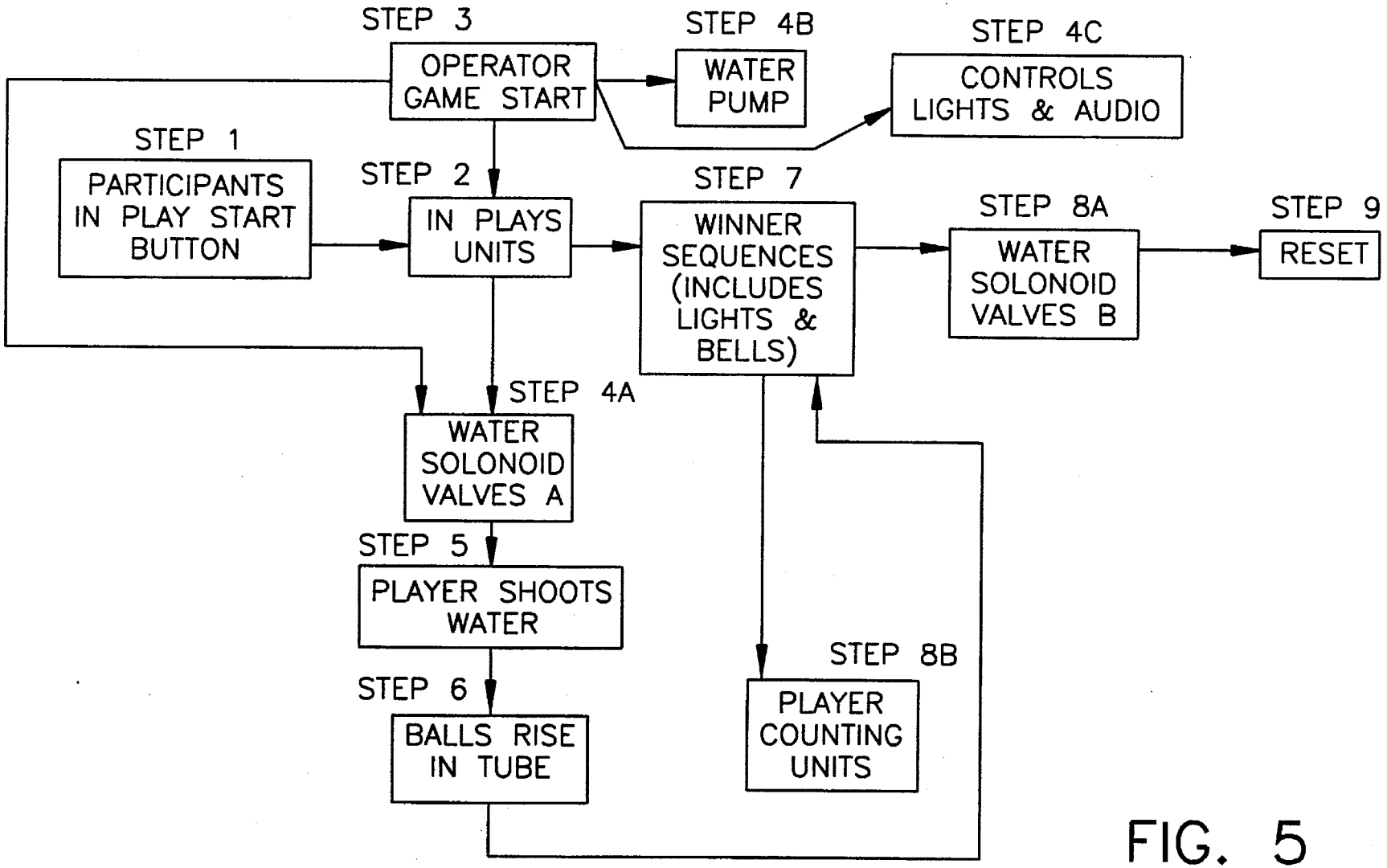
FIG. 5 is a block diagram of the system.

FIG. 5, is a block diagram of the invention. In step 1, when participants are ready to start the game, the operator activates the system, indicating which units are "in play" as in step 2. This activation starts the game sequence, open water valve "A", as shown in 4A, allowing flow to selected guns, and also starts the water pump, as in step 4B, after the operator initiates the game start as in step 3. The start of the game also initiates, as in step 4C, a sequence of background lights and audio output is similarly initiated.

As in step 5, each players shoots a stream of water at the target urinal replica. Those players who succeed in causing the stream to enter the urinal replica, cause floating balls to rise in a connecting sight tube, as in step 6. The winner, (i.e. the first player to cause the balls to rise in the tube to a predetermined point) activates the winner sequence, as in step 7, which, in turn, activates the winner sequences of lights and audio.

As in step 8A, the water solenoid valve "B" is released to recycle the water in the system and player accounting units are reset, as in step 8B. Finally, in step 9, the entire system is reset.

Figure 6A:
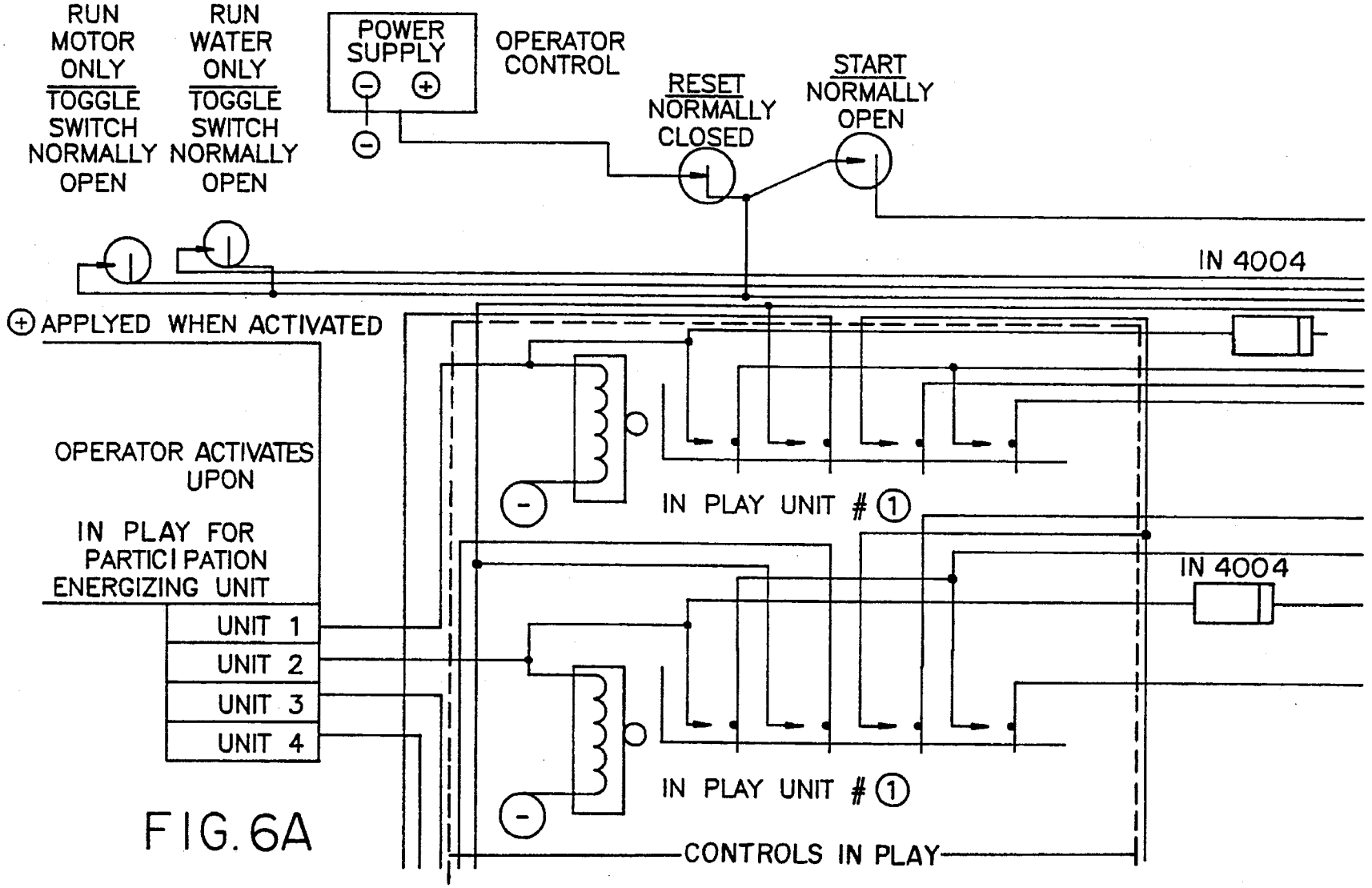
FIGS. 6A to 6G is a detailed wiring diagram of the invention.
Figure 6B:
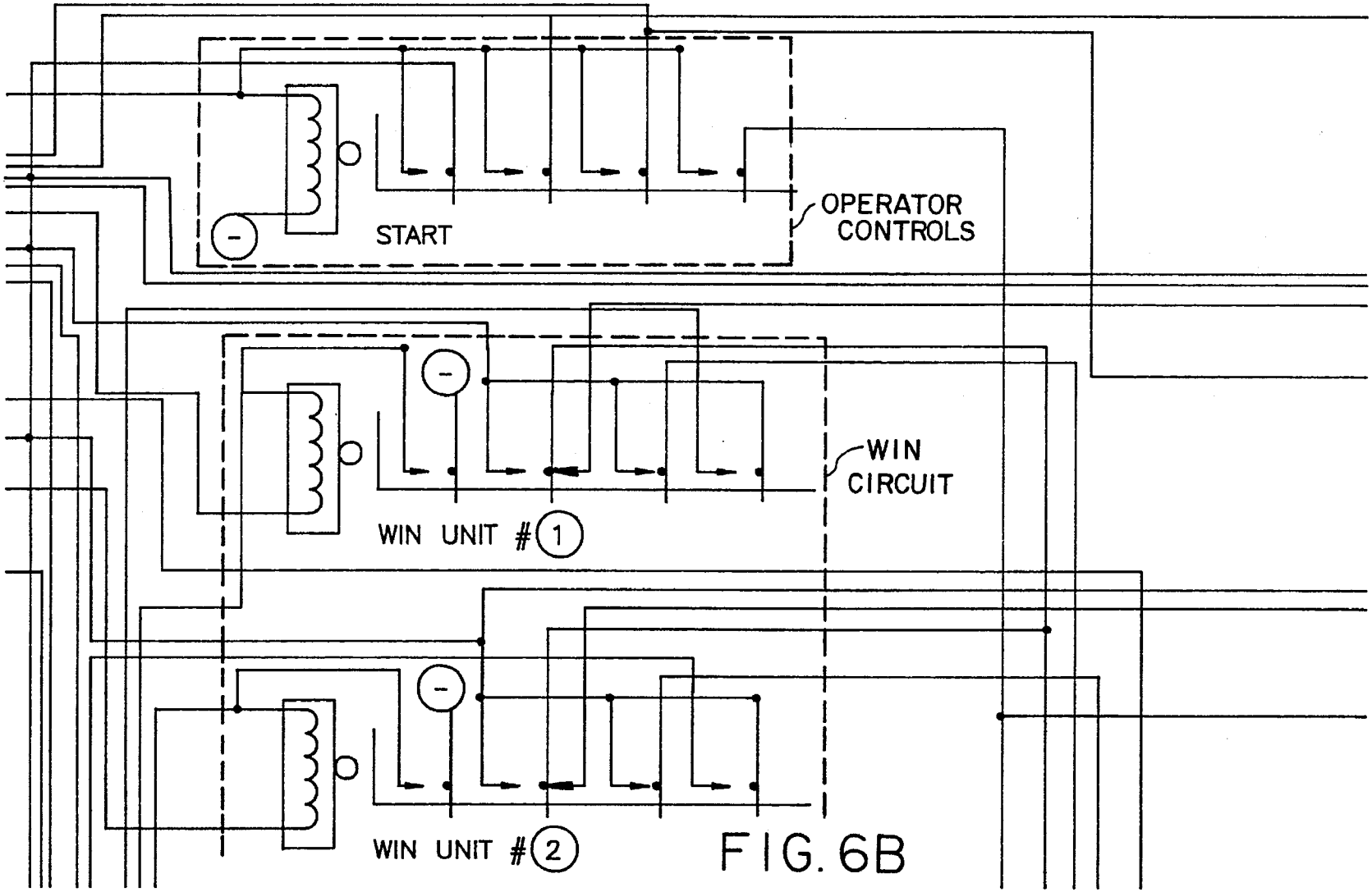
Figure 6C:
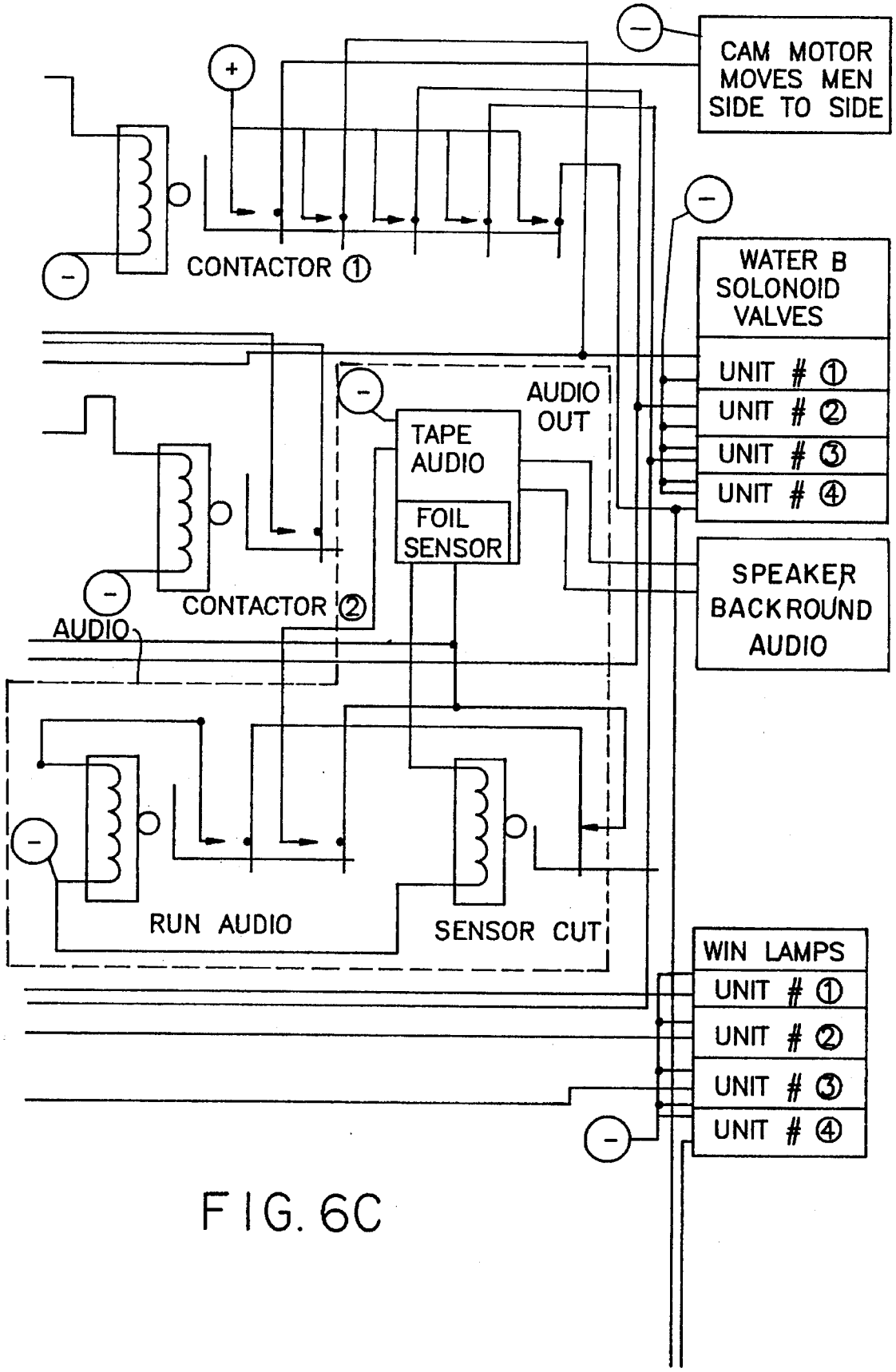
Figure 6D:
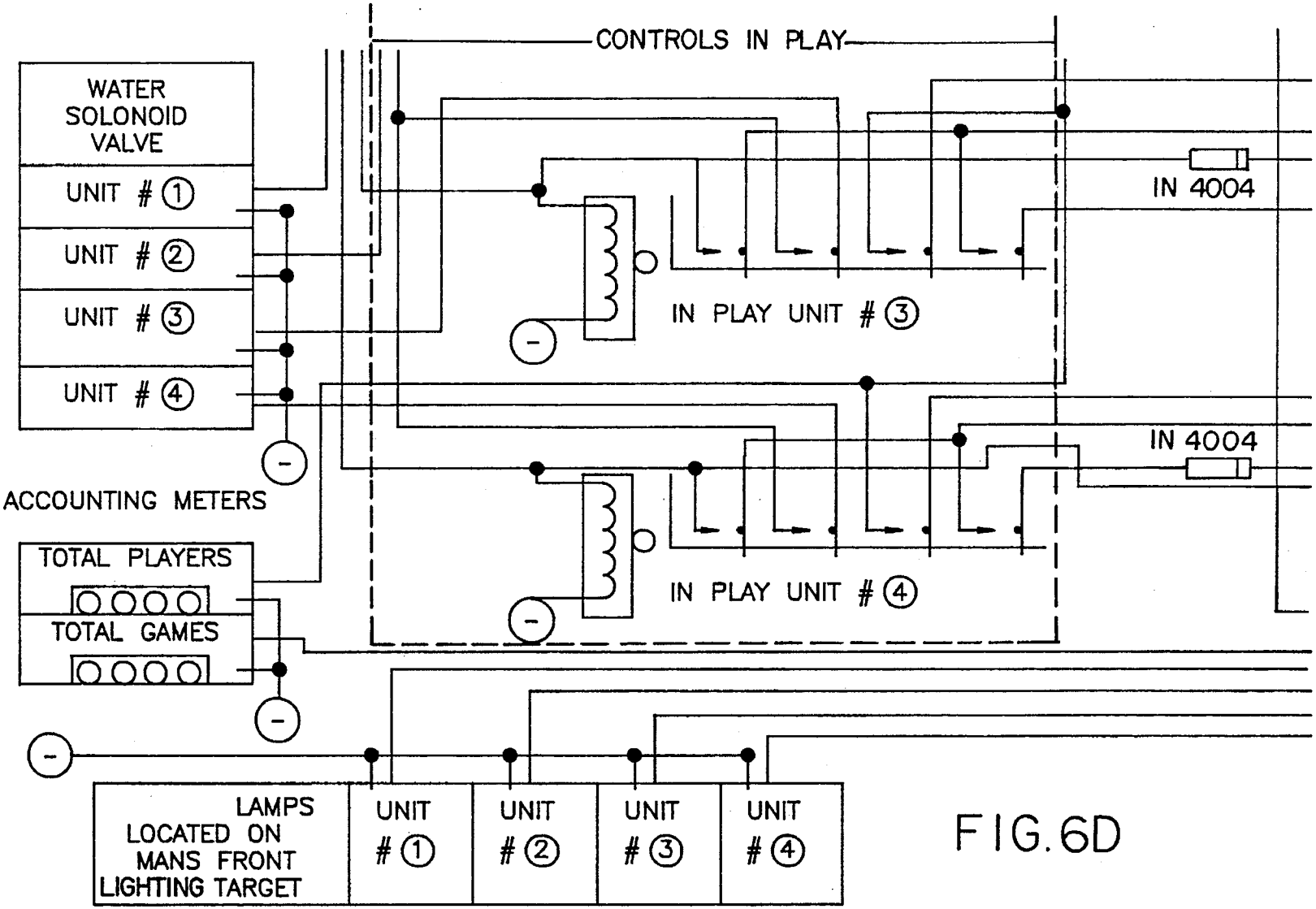
Figure 6E:
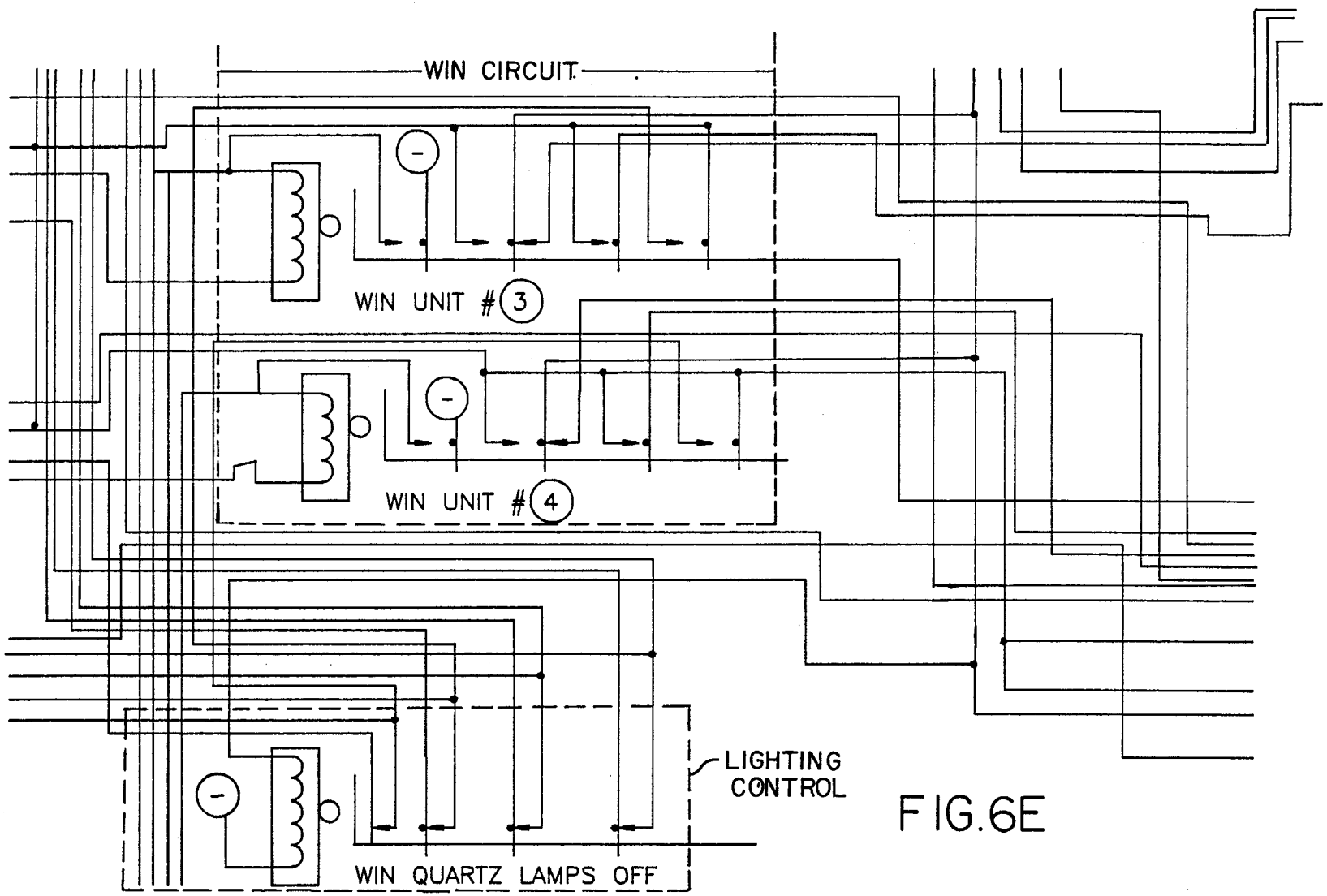

FIGS. 6A to 6G, is a diagram of an embodiment of a circuit of the invention for four players, although more or less positions can be provided. In FIGS. 6A and 6D, the section entitled "controls in play" is activated by a button. This section controls which stations are in play. In FIG. 6B, the section entitled "Operator Controls" initiates the water pump and activates the water guns and the audio and light background sequences.

Figure 6F:
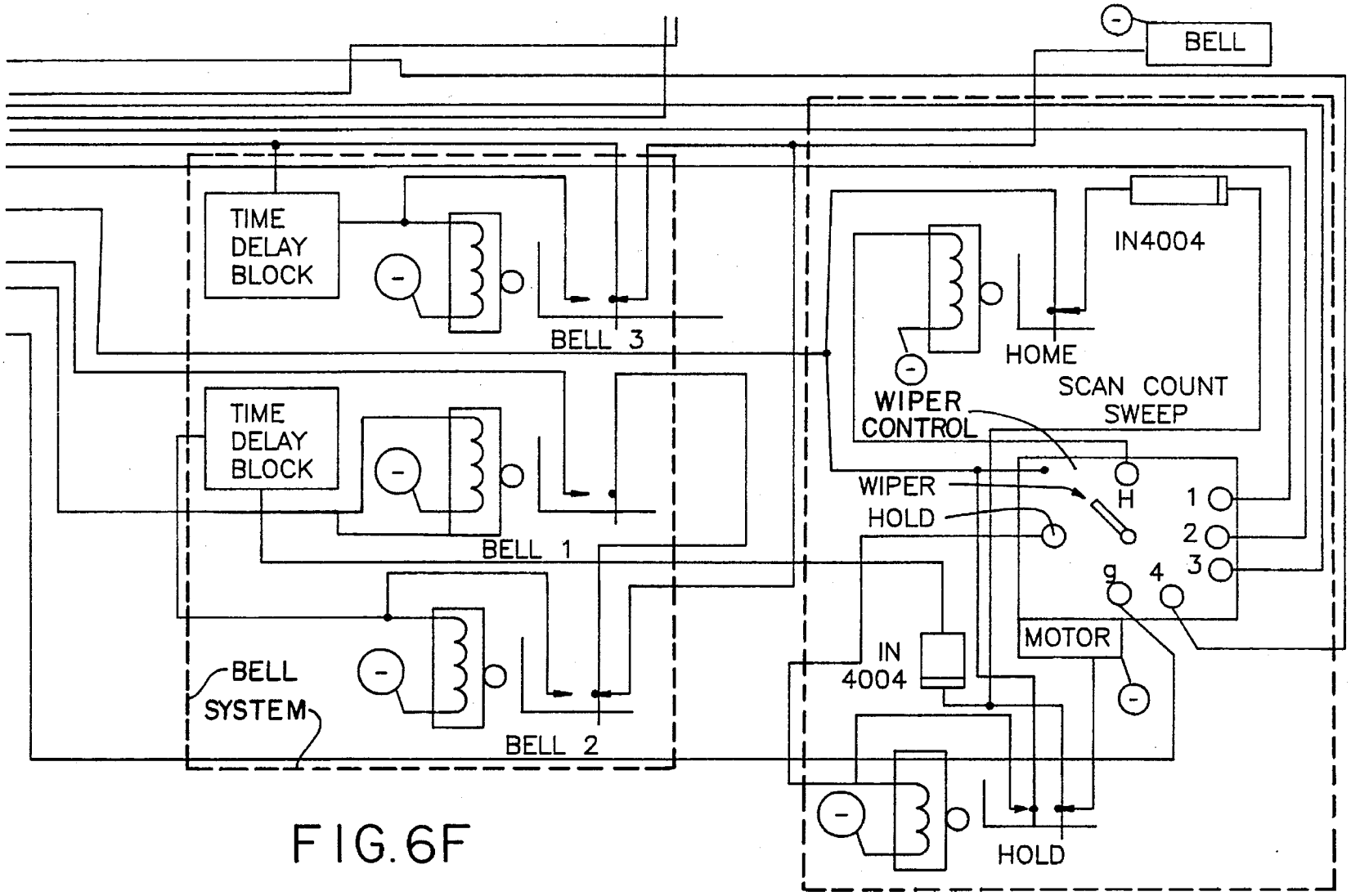
Figure 6G:
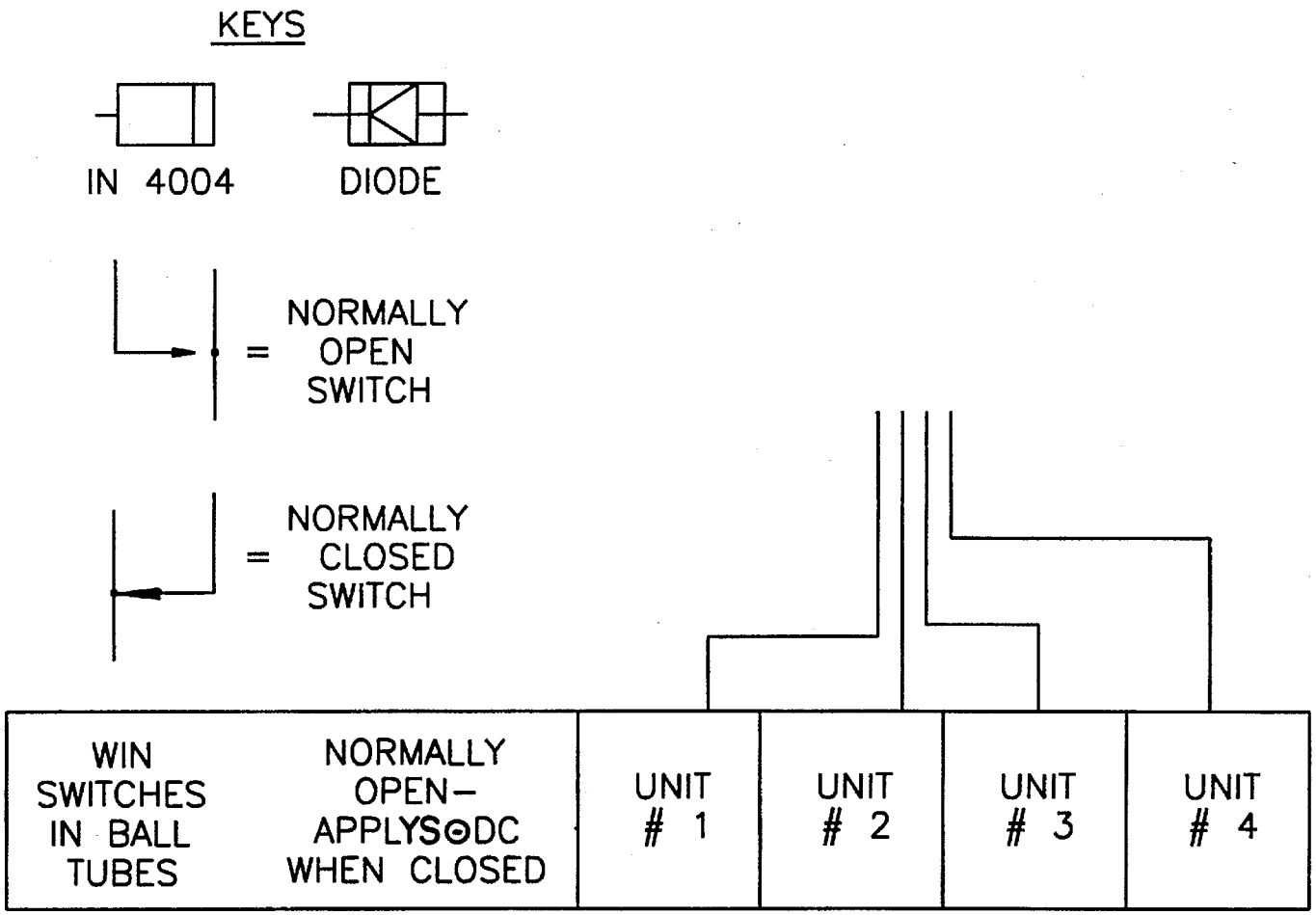
Figure 6H:
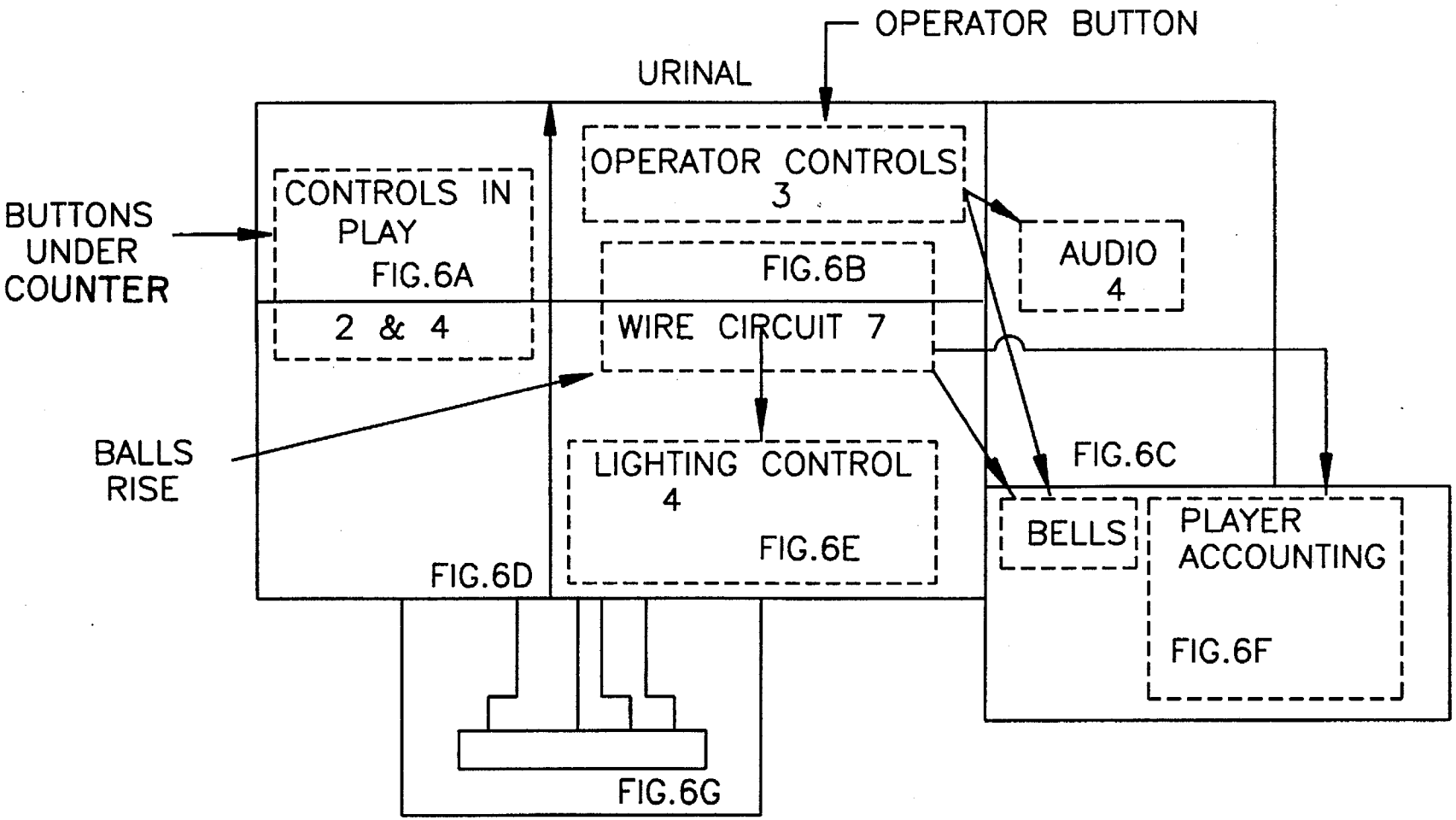
FIG. 6H shows the arrangement of FIGS. 6A to 6G.

Bells are sounded through the system entitled "Bells" as shown in FIG. 6F. The audio controls are shown in the section marked "Audio", as in FIG. 6C. The light controls are shown in the section marked "Lighting Controls", as in FIG. 6E.

When a player wins a game by being the first to cause the floating balls to rise in the sight tube, to a predetermined level, a microswitch is flipped, activating the section entitled "Win Circuit". This further initiates the "Bells", as in FIG. 6F and the "Play Accounting", which keeps track of the number of players and update game statistics, as is shown in FIG. 6F.

What I claim is:

1. An arcade game played by a plurality of participants under control of an operator comprising:

(a) A front counter having a plurality of stations;

(b) A water gun at each station connected by a hose to a water supply system, such that the water is released from the water gun upon activation by a participant and the initiation of the operator;

(c) A target positioned, approximately three to 10 feet directly in front of each station, simulative of a urinal, containing a bottom drain, such that water from the water gun is directed by a participant at the simulative urinal;

(d) A blocking mechanism being a plurality of male figures sequentially connected to each other and positioned in front of each simulative urinal;

(e) A means of moving the blocking mechanism, such that it alternatively blocks and unblocks the simulative urinals;

(f) A vertical sight tube connected to the drain of the simulative urinal such that it is placed parallel to the simulative urinal;

(g) A plurality of floating balls contained within the vertical sight tube, such that the balls rise as water rises in the tube;

(h) A win switch which is set when the participant who first causes the top floating ball to rise to predetermined position in the tube;

(i) A win circuit which is activated when the win switch is set and thereupon activates background audio and lights, indicating that a player has won the game;

(j) A means of recycling the water back to a holding tank, when the game is completed;

(k) A player counting means which is updated by the win circuit;

(l) An second audio and light system activated by the operator upon activation of game start.

* * * * *